US010390611B2

(12) United States Patent
Lee

(10) Patent No.: US 10,390,611 B2
(45) Date of Patent: Aug. 27, 2019

(54) PRIVACY SCREEN TABLE CONNECTION MECHANISM

(71) Applicant: Knoll, Inc., East Greenville, PA (US)

(72) Inventor: Jeffrey P. Lee, Mertztown, PA (US)

(73) Assignee: Knoll, Inc., East Greenville, PA (US)

( * ) Notice: Subject to any disclaimer, the term of this patent is extended or adjusted under 35 U.S.C. 154(b) by 0 days.

(21) Appl. No.: 16/190,202

(22) Filed: Nov. 14, 2018

(65) Prior Publication Data

US 2019/0142155 A1 May 16, 2019

Related U.S. Application Data

(60) Provisional application No. 62/586,380, filed on Nov. 15, 2017.

(51) Int. Cl.
*A47B 13/08* (2006.01)
*A47B 9/20* (2006.01)

(52) U.S. Cl.
CPC ..... *A47B 13/088* (2013.01); *A47B 9/20* (2013.01); *A47B 2200/12* (2013.01)

(58) Field of Classification Search
CPC ..... A47B 57/00; A47F 5/005
USPC ..... 108/60, 61, 50.01, 50.02
See application file for complete search history.

(56) References Cited

U.S. PATENT DOCUMENTS 905,965 A * 12/1908 Wilde ..... A47B 65/00 108/28
974,340 A * 11/1910 Bebb ..... A47B 65/00 108/28
2,688,525 A * 9/1954 Lindstrom ..... A47B 21/03 108/60
2,694,614 A * 11/1954 Dent ..... A47B 83/001 108/60
2,821,450 A * 1/1958 Knoll ..... A47B 83/001 108/60
2,942,924 A * 6/1960 Stangert ..... A47B 21/03 312/140.4
3,083,417 A * 4/1963 Cook ..... A47B 41/00 108/60
3,685,465 A * 8/1972 Haumer ..... A47B 47/0041 108/60
4,314,700 A * 2/1982 Dylag ..... A63F 1/06 108/60
4,604,955 A 8/1986 Fleischer et al.
4,763,581 A * 8/1988 Weese ..... A47B 83/00 108/60
4,870,908 A * 10/1989 Wolters ..... A47B 83/001 108/60
5,224,429 A 7/1993 Borgman et al.
5,408,940 A 4/1995 Winchell
5,562,052 A 10/1996 Glashouwer et al.
5,598,789 A 2/1997 Jonker
5,706,739 A 1/1998 Shaheen et al.
5,715,761 A 2/1998 Frattini
(Continued)

*Primary Examiner* — Jose V Chen

(74) *Attorney, Agent, or Firm* — Buchanan Ingersoll & Rooney PC

(57) ABSTRACT

A table arrangement includes connection mechanisms height adjustable tabletops so that the tabletops are independently moveable while a privacy screen is positionable between the tabletops. Embodiments of the table arrangement can be configured so that different height adjustable tabletops can be arranged to accommodate different users' preferences.

20 Claims, 7 Drawing Sheets

(56) References Cited

U.S. PATENT DOCUMENTS

| | | | |
|---|---|---|---|
| 5,881,979 | A | 3/1999 | Rozier, Jr. et al. |
| 5,941,182 | A | 8/1999 | Greene |
| 6,029,587 | A | 2/2000 | Rozier, Jr. et al. |
| 6,164,217 | A | 12/2000 | Prendergast |
| 6,389,988 | B1 | 5/2002 | Frattini |
| 6,536,357 | B1 | 3/2003 | Hiestand |
| 6,546,880 | B2 | 4/2003 | Agee |
| 6,637,352 | B1 | 10/2003 | Thode et al. |
| 6,845,723 | B2 | 1/2005 | Kottman et al. |
| 7,066,098 | B2 | 6/2006 | Blasen et al. |
| 7,614,351 | B2 | 11/2009 | Piretti |
| 7,712,422 | B2 | 5/2010 | Bue |
| 7,845,290 | B2 | 12/2010 | Piretti |
| 7,878,128 | B2 | 2/2011 | Watson et al. |
| 8,051,784 | B2 | 11/2011 | Hsu |
| 8,056,489 | B2 | 11/2011 | Nielsen |
| 3,069,795 | A1 | 12/2011 | Williams et al. |
| 8,091,488 | B2 | 1/2012 | Chirea et al. |
| 8,171,863 | B2 | 5/2012 | Nyenhuis et al. |
| 8,256,359 | B1 | 9/2012 | Agee |
| 3,297,208 | A1 | 10/2012 | Hoffman |
| 8,359,983 | B2 | 1/2013 | Williamson et al. |
| 3,413,593 | A1 | 4/2013 | Korb |
| 8,578,864 | B2 | 11/2013 | Nyenhuis et al. |
| 8,667,909 | B2 | 3/2014 | Ruzicka |
| 8,869,715 | B2 | 10/2014 | Hoffman |
| 9,265,340 | B2 | 2/2016 | Krusin et al. |
| 9,585,468 | B2 | 3/2017 | Udagawa et al. |
| 2002/0092443 | A1* | 7/2002 | Grant ..... E04H 1/1255 108/60 |
| 2008/0196635 | A1 | 8/2008 | Piretti |
| 2012/0126072 | A1 | 5/2012 | Pettersson |
| 2013/0204438 | A1 | 8/2013 | Hjelm |
| 2014/0312754 | A1* | 10/2014 | Hecht ..... A47B 9/04 312/309 |

* cited by examiner

PRIVACY SCREEN TABLE CONNECTION MECHANISM

CROSS-REFERENCE TO RELATED APPLICATIONS

The present application claims priority to U.S. Provisional Patent Application No. 62/586,380, which was filed on Nov. 15, 2017.

FIELD OF INVENTION

The innovation relates to connection mechanisms that can be used in connection with table arrangements and height adjustable table arrangements for connecting a privacy screen between two adjacent tables. The innovation also relates to methods of making and using such connection mechanisms.

BACKGROUND OF THE INVENTION

Table arrangements can be utilized in different types of settings. In some office workplaces, tables can be arranged next to each other and separated via a cubicle system for example. In other arrangements, tables can be positioned in a large conference room for a conference. In yet other arrangements, a group of tables can be positioned near each other to facilitate collaborative work. Examples of tables and table arrangements can be appreciated from U.S. Patent Application Publication Nos. 2013/0204438 and 2012/0126072 and U.S. Pat. Nos. 9,585,468, 9,265,340, 8,667,909, 8,256,359, 8,056,489, 6,546,880, 6,536,357, 6,389,988, 6,029,587, 5,941,182, 5,881,979, 5,715,761, 5,706,739, 5,598,789, 5,562,052, 5,224,429, 5,408,940, and 4,604,955.

SUMMARY OF THE INVENTION

A new connection mechanism and method of using the connection mechanism are provided herein for positioning of a privacy screen between tabletops. I have determined that such a mechanism is needed to help facilitate an improvement in arranging tables so that tables and height adjustable tables can be arranged in various ways and still provide privacy to the different personnel working at those different locations. In some embodiments, embodiments of my connection mechanism can be utilized in inter-connected table arrangements in which one table may be connected to at least one other table so that each table's tabletop is independently height adjustable and a privacy screen is connected to a frame that supports those tabletops for being positioned between the tabletops and extending above the tabletops. As another example, some embodiments of my table connection mechanism can be utilized so that a workspace can have at least two tabletops that are independently moveable relative to each other so at least to co-workers can use those tabletops in a workplace at different adjustable heights without having table legs positioned near the user's so that the users each have a significant amount of leg space to accommodate their comfort and desired working positions for each tabletop while also having their privacy protected via the positioning of a privacy screen between the tabletops.

Embodiments of a table arrangement are provided. The table arrangement can be structured as an article configured to support multiple height adjustable work surfaces. The work surfaces may be considered tabletops that function as a desktop, countertop, tabletop, or other similar work surface. For example, an embodiment of the table arrangement can include a first tabletop, a second tabletop, and a base that supports the first tabletop and the second tabletop. The base can include a first column positioned below the first tabletop, a second column positioned below the second tabletop, and a base member positioned between the first column and the second column. The base member can also be positioned below a gap defined between the first tabletop and the second tabletop. The base member can have a first slot. A first privacy screen connector can be positioned adjacent the base member so that a lower end portion of the first privacy screen connector extends downwardly from the first slot. An upper portion of the first privacy screen connector can be configured to receive and retain a first portion of a privacy screen member. In some embodiments, the privacy screen member can be structured as a partition panel, a partition wall, a privacy screen or other type of privacy screen element that helps provide a visible barrier.

Embodiments of the table arrangement can include other elements. For example, embodiments can include a second privacy screen connector positioned adjacent the base member so that a lower end portion of the second privacy screen connector extends downwardly from a second slot of the base member. An upper portion of the second privacy screen connector can be configured to receive and retain a second portion of the privacy screen member. Embodiments can also include a first bracket positioned within a bottom opening of the base member adjacent the first slot to receive the lower end portion of the first privacy screen connector. The first bracket can include a first bracket body that is spaced apart from a second bracket body to define a gap of the first bracket for receiving the lower end portion of the first privacy screen connector. A second bracket can be positioned within the bottom opening of the base member adjacent the second slot to receive the lower end portion of the second privacy screen connector. The second bracket can include a first bracket body that is spaced apart from a second bracket body to define a gap of the second bracket for receiving the lower end portion of the second privacy screen connector.

The table arrangement can also include other elements. For instance, the table arrangement can include a first cross-member extending between the first column and the second column. The first bracket body of the first bracket can be attached to the first cross-member and the second bracket body of the first bracket can be attached to the first cross-member. The table arrangement can also include a third column positioned below the first tabletop and a fourth column positioned below the second tabletop and a second cross-member extending between the third column and the fourth column. The first bracket body of the second bracket can be attached to the second cross-member and the second bracket body of the second bracket can be attached to the second cross-member. In some embodiments, the first slot of the base member can be aligned with the gap of the first bracket and the second slot of the base member can be aligned with the gap of the second bracket.

The upper portion of the first privacy screen connector can have a number of different configurations. In some embodiments, the upper portion of the first privacy screen connector can include a first upper body that is spaced apart from a second upper body to define a top mouth and a channel in communication with the top mouth for receipt and retention of the first portion of the privacy screen member. The upper portion of the second privacy screen connector can also have multiple different configurations. For instance, the upper portion of the second privacy screen connector can include a first upper body that is spaced apart from a second upper body to define a top mouth and a channel in communication with the top mouth for receipt and retention of the second portion of the privacy screen member.

The lower end portions of the first privacy screen connector and the second privacy screen connector can also have different configurations. In some embodiments, the lower end portion of the first privacy screen connector can include a first lower body abutting a second lower body. The lower end portion of the second privacy screen connector can also include a first lower body abutting a second lower body.

The first privacy screen connector and second privacy connector can each include other elements. For instance, the first privacy screen connector can include a first intermediate body that extends between the first upper body and the first lower body of the first privacy screen connector and a second intermediate body that extends between the second upper body and the second lower body of the first privacy screen connector. The first intermediate body and the second intermediate body of the first privacy screen connector can be positioned and configured so that the channel of the first privacy screen connector is narrower at a bottom end of the channel as compared to a portion of the channel adjacent the top mouth of the first privacy screen connector. The second privacy screen connector can also include a first intermediate body that extends between the first upper body and the first lower body of the second privacy screen connector and a second intermediate body that extends between the second upper body and the second lower body of the second privacy screen connector. The first intermediate body and the second intermediate body of the second privacy screen connector can be positioned and configured so that the channel of the second privacy screen connector is narrower at a bottom end of the channel as compared to a portion of the channel adjacent the top mouth of the second privacy screen connector.

A method of positioning a privacy screen between tabletops of a table arrangement is also provided. Some embodiments of the method can utilize an embodiment of the table arrangement. For instance, an embodiment of the method can include providing an embodiment of the table arrangement that includes a first tabletop, a second tabletop, and a base that supports the first tabletop and the second tabletop where the base includes a first column positioned below the first tabletop, a second column positioned below the second tabletop, and a base member positioned between the first column and the second column where the base member is also positioned below a gap defined between the first tabletop and the second tabletop, the base member having a first slot and a second slot spaced apart from the first slot. Embodiments of the method can also include: (i) positioning a first privacy screen connector adjacent the base member so that a lower end portion of the first privacy screen connector extends downwardly from the first slot and an upper portion of the first privacy screen connector extends upwardly from the first slot and is configured to receive and retain a first portion of a privacy screen member; (ii) positioning a second privacy screen connector adjacent the base member so that a lower end portion of the second privacy screen connector extends downwardly from the second slot and an upper portion of the second privacy screen connector extends upwardly from the second slot and is configured to receive and retain a second portion of the privacy screen member; and (iii) positioning the first portion of the privacy screen member in a channel of the first privacy screen connector and positioning the second portion of the privacy screen member in a channel of the second privacy screen connector such that the privacy screen member extends through the gap and extends above the first tabletop and the second tabletop.

Embodiments of the method can also include other steps. For instance, embodiments of the method can also include positioning a lower end portion of the first privacy screen connector between a gap of a first bracket for attachment to the first bracket and positioning a lower end portion of the second privacy screen connector in a gap of the second bracket for attachment to the second bracket. The first and second brackets can be positioned so that the gap of the first bracket is aligned with the first slot of the base member and the gap of the second bracket is aligned with the second slot of the base member. Embodiments of the method can also include attaching the first bracket to a first cross-member and attached the second bracket to a second cross-member.

Other details, objects, and advantages of the invention will become apparent as the following description of certain exemplary embodiments thereof and certain exemplary methods of practicing the same proceeds.

BRIEF DESCRIPTION OF THE DRAWINGS

Exemplary embodiments of a table arrangement and connection mechanisms used in the table arrangement are shown in the accompanying drawings and certain exemplary methods of making and practicing the same are also illustrated therein. It should be appreciated that like reference numbers used in the drawings may identify like components.

FIG. 3 illustrates a first end section of a base member 21 of the first exemplary embodiment of the table arrangement 1. A second end section of the base member 21 of the first exemplary embodiment of the table arrangement would have a mirror image view as this first end section view shown in FIG. 3.

DETAILED DESCRIPTION OF EXEMPLARY EMBODIMENTS

Figure 1:
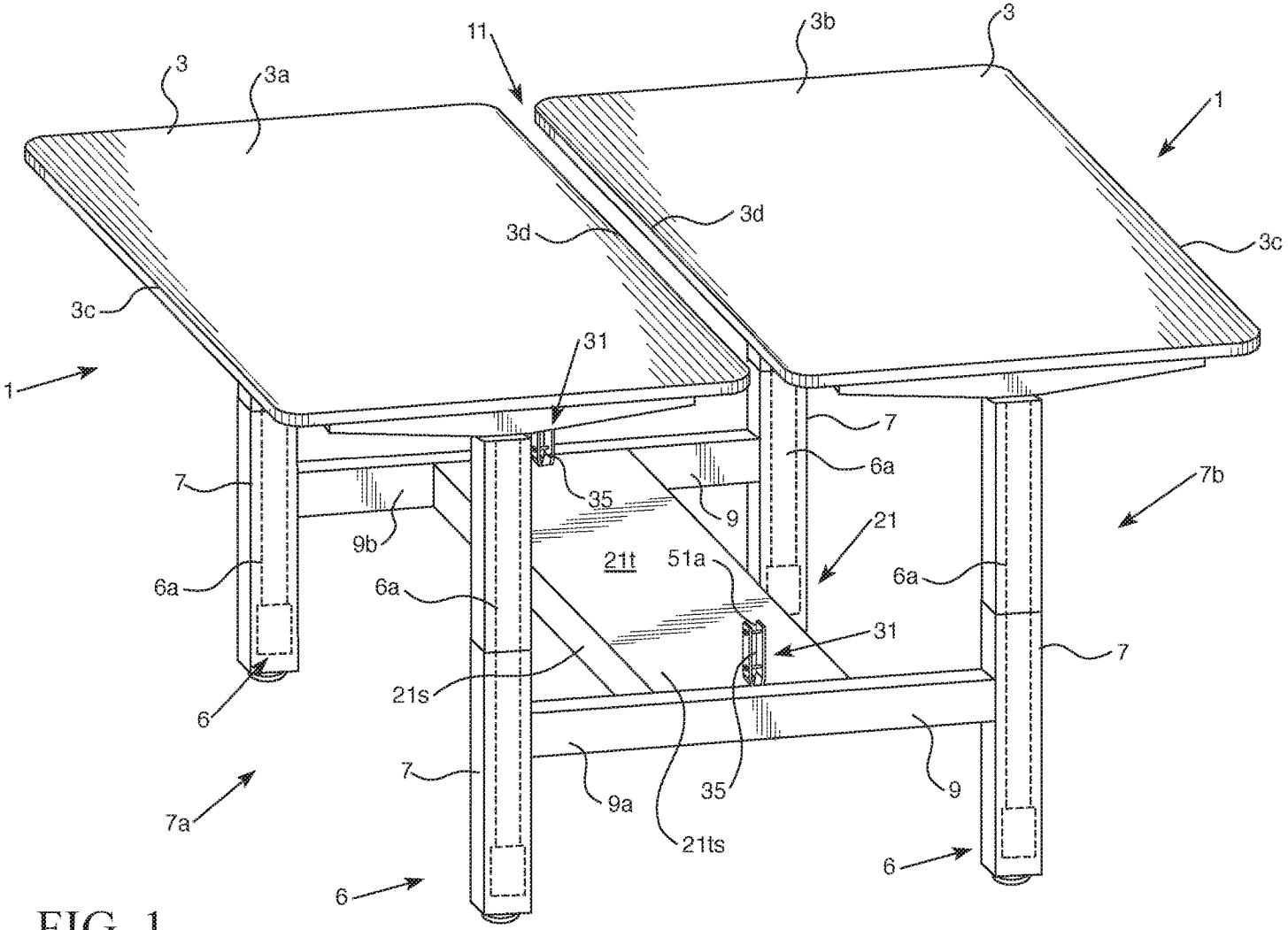
FIG. 1 is a perspective view of a first exemplary embodiment of a table arrangement 1 having multiple tabletops 3 that are independently height adjustable such that a first tabletop 3*a* is moveable to a different vertical position than a second tabletop 3*b* with a privacy screen element being removed to better illustrate the gap 11 between the tabletops 3.
Figure 2:
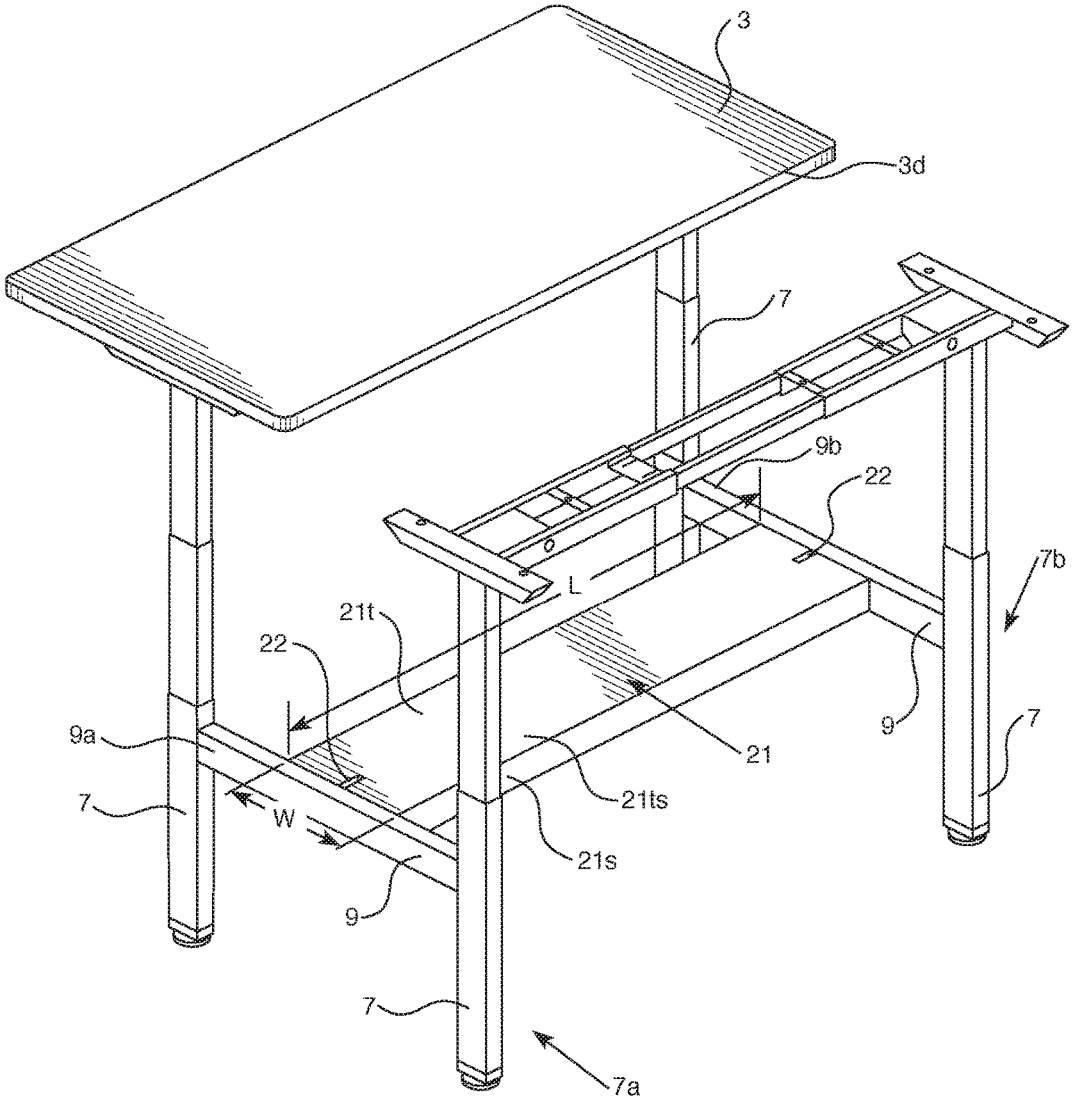
FIG. 2 is a perspective view of the first exemplary embodiment of the table arrangement 1 with a tabletop cut away to better illustrate a lower cross bar member extending between the columns 7 and underneath the gap 11 that has slots 21 at its opposite ends.
Figure 3:
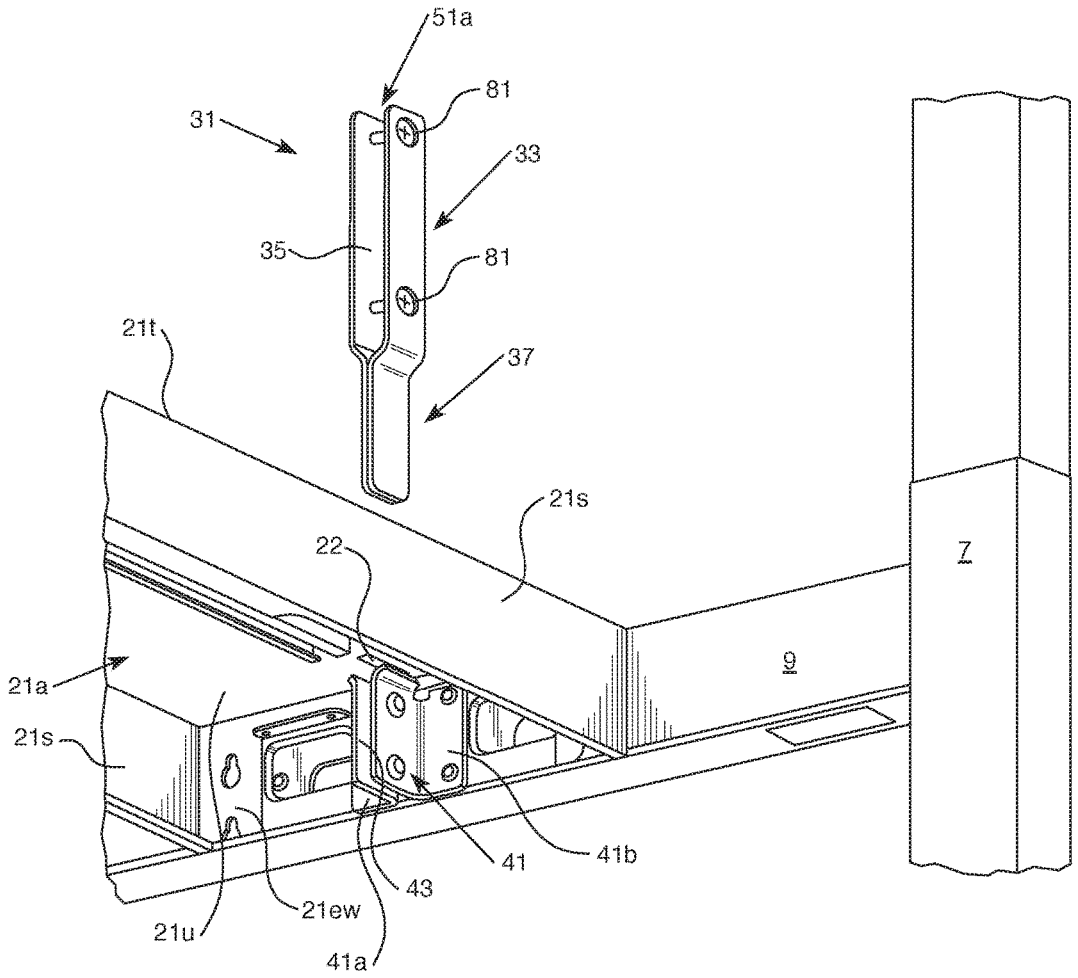
FIG. 3 is a fragmentary enlarged exploded view of the first exemplary embodiment of the table arrangement 1 with a portion of privacy screen connection mechanism for positioning in a slot 21 shown in an exploded view.
Figure 4:
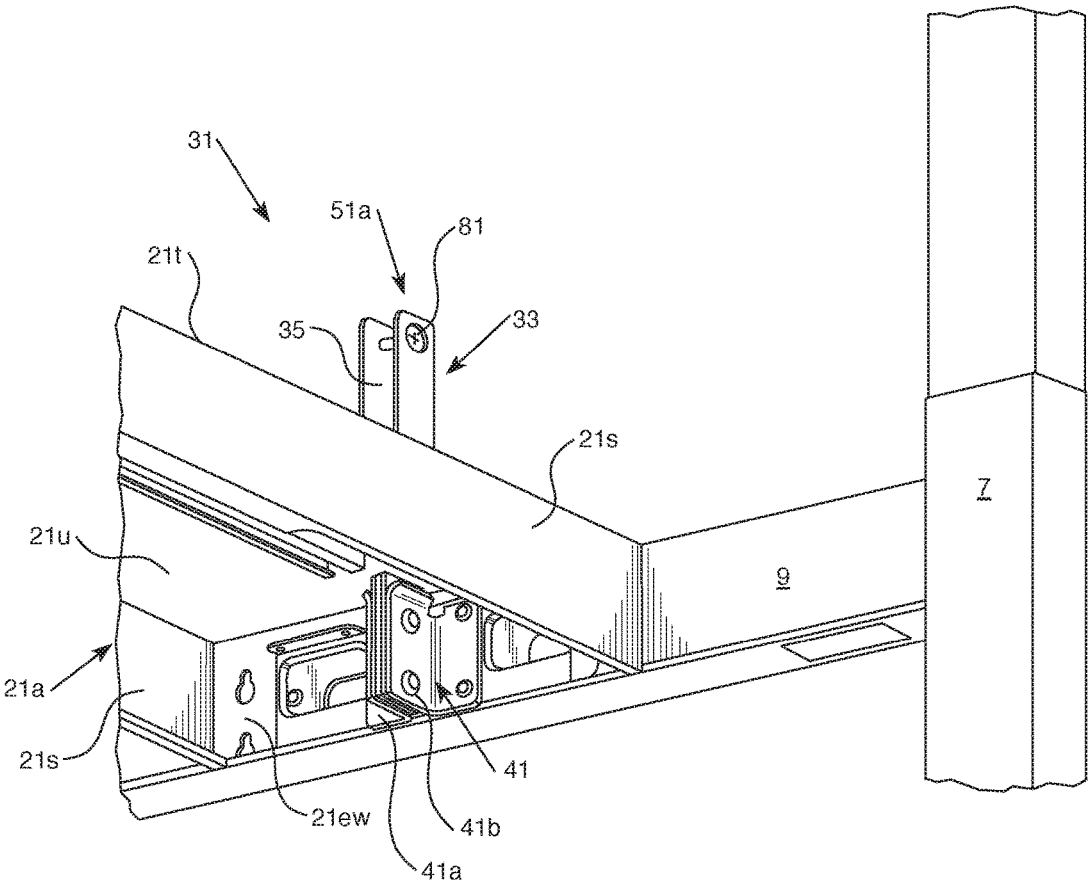
FIG. 4 is a view similar to FIG. 3 illustrating the portion of the privacy screen connector 31 positioned in the slot 21 for a first end section of the base member 21. A second end section of the base member 21 of the first exemplary embodiment of the table arrangement 1 would have another privacy screen connector 31 positioned in another slot 22. A mirror image view of the first end section view shown in FIG. 4 would illustrate this second end privacy screen connector 31 positioned in the other slot 22.

Referring to FIGS. 1-8 a table arrangement 1 can include an assembly 2 that includes multiple tabletops 3 that are supported by a base 4. The base can include a plurality of columns 7 and cross-members 9. The columns 7 can include a first column and a third column that are positioned to support a first tabletop 3*a* and a second column and a fourth column that support a second tabletop 3*b*. The base 4 can also include a base member 21 positioned between the cross-members 9 under the tabletops 3.

The table arrangement 1 can also include at least one trough that can be connected to the underside of a tabletop 3 or to a cross member that is above the base member 21 that extends between columns 7 so that the trough can be positioned adjacent and below a gap 11 to help route cords, wiring, or other elements that may extend toward or from objects positioned on the tabletop (e.g. power cords for transmission of electricity to that are spaced apart from each other to align with the gap 11 defined between rear edges 3*d* of first and second tabletops 3*a* and 3*b* so that a privacy screen member 71 can extend between troughs and through the gap 11. In yet other embodiments, the table arrangement 1 may not include any troughs.

The first and third columns can be considered columns of a first set 7*a* of columns 7 for principally supporting the first tabletop 3*a*. The second and fourth columns can be considered a second set 7*b* of columns 7 for principally supporting the second tabletop 3*b*.

A first cross-member 9 can extend between a first column 7 that is connected to principally support the first tabletop 3*a* and the second column 7 that is positioned to principally support the second tabletop 3*b*. A second cross-member 9 can extend between the third column 7 that is connected to principally support the first tabletop 3*a* and the fourth column 7 that is positioned to principally support a second tabletop 3*b*. For some table arrangements, the table arrangement could be considered a workspace arrangement or cubicle type arrangement in which each tabletop 3 could be considered a work surface, a tabletop, a desktop, or a countertop.

Each of the columns 7 can extend vertically along their length from a floor and the cross-members 9 can extend horizontally along their length between the columns to which it is connected. The first and second tabletops 3*a* and 3*b* can be positioned so that the tabletops' rear edges 3*d* are spaced apart from each other to define a gap 11. The columns 7 can be positioned so that the columns 7 of the first set 7*a* of columns are positioned under the first tabletop 3*a* and the columns of the second set 7*b* of columns are positioned under the second tabletop 3*b*. For instance, the first set 7*a* of columns can include a pair of columns 7 that are spaced apart from each other and are located on opposite sides (e.g. left and right sides) of the first tabletop 3*a* near a middle section of the first tabletop 3*a* and the second set 7*b* of columns can include a pair of columns 7 that are spaced apart from each other and are located on opposite sides (e.g. left and right sides) of the second tabletop 3*b* near a middle section of the first tabletop 3*b*.

At least one lower base member 21 can be positioned below the gap 11 and between the columns 7 and cross-members 9 to facilitate positioning of at least one privacy screen member 71 (e.g. a privacy screen panel, a partition panel, a partition wall, etc.) that may extend through the gap 11 and above the tabletops 3 (e.g. cubical wall elements, privacy screen elements, etc.). The base member 21 can extend horizontally from a first side of each tabletop 3 to a second side of each tabletop 3 so that the base member 21 extends between the first and second cross-members 9*a* and 9*b* that each extends between a respective pair of columns 7 (the first cross-member 9*a* being positioned outside of and adjacent the first end of the base member 21 and the second cross-member 9*b* being positioned outside of and adjacent the second end of the base member 21).

Each column 7 can be configured to facilitate height adjustment of a tabletop 3. For example, the first set 7*a* of columns can be positioned adjacent a middle portion of the first tabletop 3*a* on opposite sides of the first tabletop between front and rear sides of the tabletop 3. Each column of the first set 7*a* of columns can include a telescoping member 6*a* that is extendable and retractable from a lower member of the column 7 so that actuation of the telescoping member results in height adjustment of the tabletop from a lowermost position to an uppermost position. As another example, the second set 7*b* of columns can be positioned adjacent a middle portion of the second tabletop 3*b* on opposite sides of the second tabletop 3*b* between front and rear sides of the tabletop 3. Each column 7 of the second set 7*b* of columns can include a telescoping member 6*a* that is extendable and retractable from a lower member of the column 7 so that actuation of the telescoping member results in height adjustment of the tabletop 3 between a lowermost position to an uppermost position.

Each column 7 can include a height adjustment mechanism 6 (e.g. a gas spring, hydraulic spring, etc.) that is connected to the telescoping member 6*a* to drive motion of the telescoping member 6*a*. The height adjustment mechanism 6 can be coupled to an actuator to facilitate such height adjustment. A user may utilize the actuator to provide input for actuation of the height adjustment mechanism 6 so that the telescoping members 6*a* are vertically moveable for adjusting a position of a tabletop 3.

Referring to FIGS. 2-8, the base member 21 can include slots 22 that are positioned adjacent the opposite ends of the base member 21 where each slot 22 is also adjacent a respective one of the cross-members 9. For instance, there can be a first slot 22 positioned near a first end of the base member 21 adjacent a first cross-member 9*a* and a second slot 22 that is positioned near a second end of the base member 21 adjacent a second cross-member 9*b*. The first slot 22 can be positioned adjacent to and in alignment with a first bracket 41 attached to the first cross-member 9*a* and the second slot 22 can be positioned adjacent to and in alignment with a second bracket 41 attached to the second cross-member 9*b*. Each slot 22 can communicate with a bottom opening 21*a* of the base member 21. The bottom opening 21 can be defined by sidewalls 21*s* of the base member 21 that extend below a top 21*t* of the base member. The top 21*t* of the base member 21 can include an underside surface 21*u* and a top surface 21*ts* opposite the underside surface 21*u*. The underside surface 21*u* can help define the shape and size of the bottom opening 21*a*. The bottom opening 21*a* can be defined as a cavity, channel, or recess type opening between the sidewalls 21*s* and top 21*t* of the base member 21 in some embodiments. In some embodiments, end walls 21*ew* can also extend downwardly from the top 21*t* of the base member to help define a shape of the bottom opening 21*a*.

There can be multiple brackets 41 positioned in the bottom opening 21*a* of the base member 21. Each bracket 41 can be positioned adjacent a respective cross-member 9. For instance, there can be a first bracket 41 attached to a first cross-member 9 adjacent a first end of the base member 21 and a second bracket 41 attached to a second cross-member 9 adjacent a second end of the base member 21. In some embodiments, a portion of an end wall 21*ew* of the base member can be positioned between the between the bracket 41 and the cross-member to which that bracket is attached.

Each bracket 41 can be formed via attachment of a first bracket body 41*a* and a second bracket body 41*b* to an end wall 21*ew* of the base member 21 and/or a cross-member 9 via fasteners so that the spaced apart first and second bracket bodies 41*a* and 41*b* define a gap 43 between the bracket bodies for receipt of a lower portion of a privacy screen connector 31 that may extend below the slot 22 to which the bracket 41 is positioned under and aligned. For example, first and second bracket bodies 41*a* and 41*b* of a first bracket 41 can be attached to a first cross-member 9 and/or a first end wall 21*ew* and first and second bracket bodies 41*a* and 41*b* of a second bracket 41 can be attached to a second cross-member 9 and/or a second end wall 21*ew*. The first bracket 41 can be positioned to be under and aligned with a first slot 22 adjacent a first end of the base member 21 and the second bracket 41 can be positioned to be under and aligned with a second slot 22 adjacent a second end of the base member 21.

Figure 5:
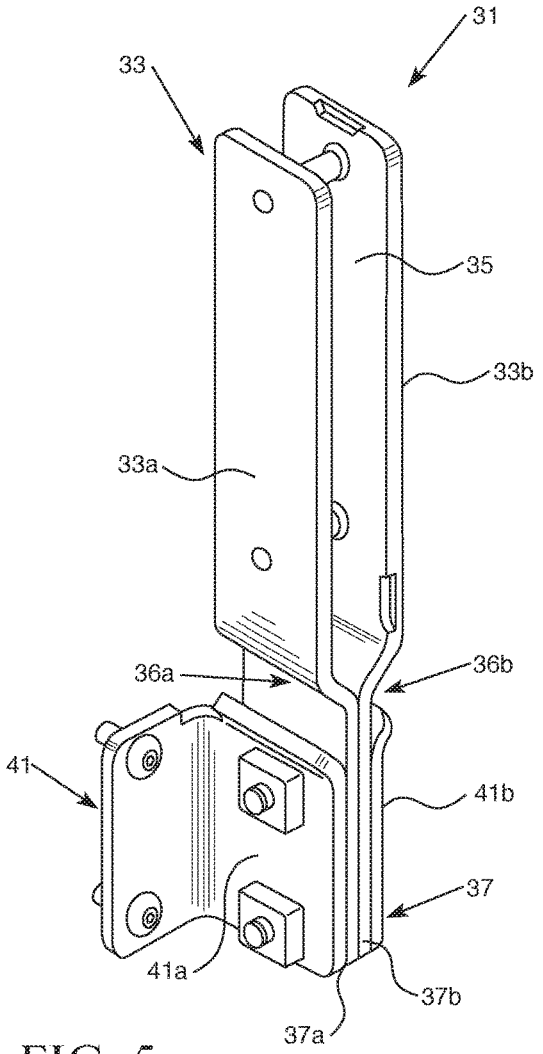
FIG. 5 is perspective view of an exemplary embodiment of a privacy screen connector 31 that is utilized in the first exemplary embodiment of the table arrangement 1.
Figure 6:
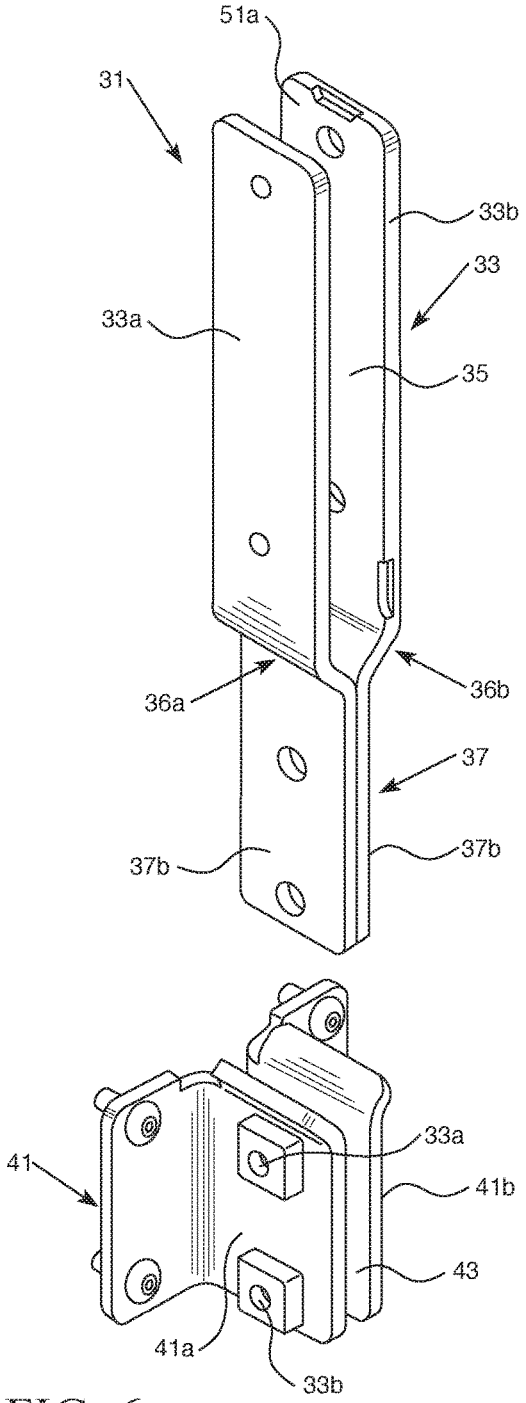
FIG. 6 is a first exploded view of the exemplary embodiment of the privacy screen connector 31 shown in FIG. 5.
Figure 7:
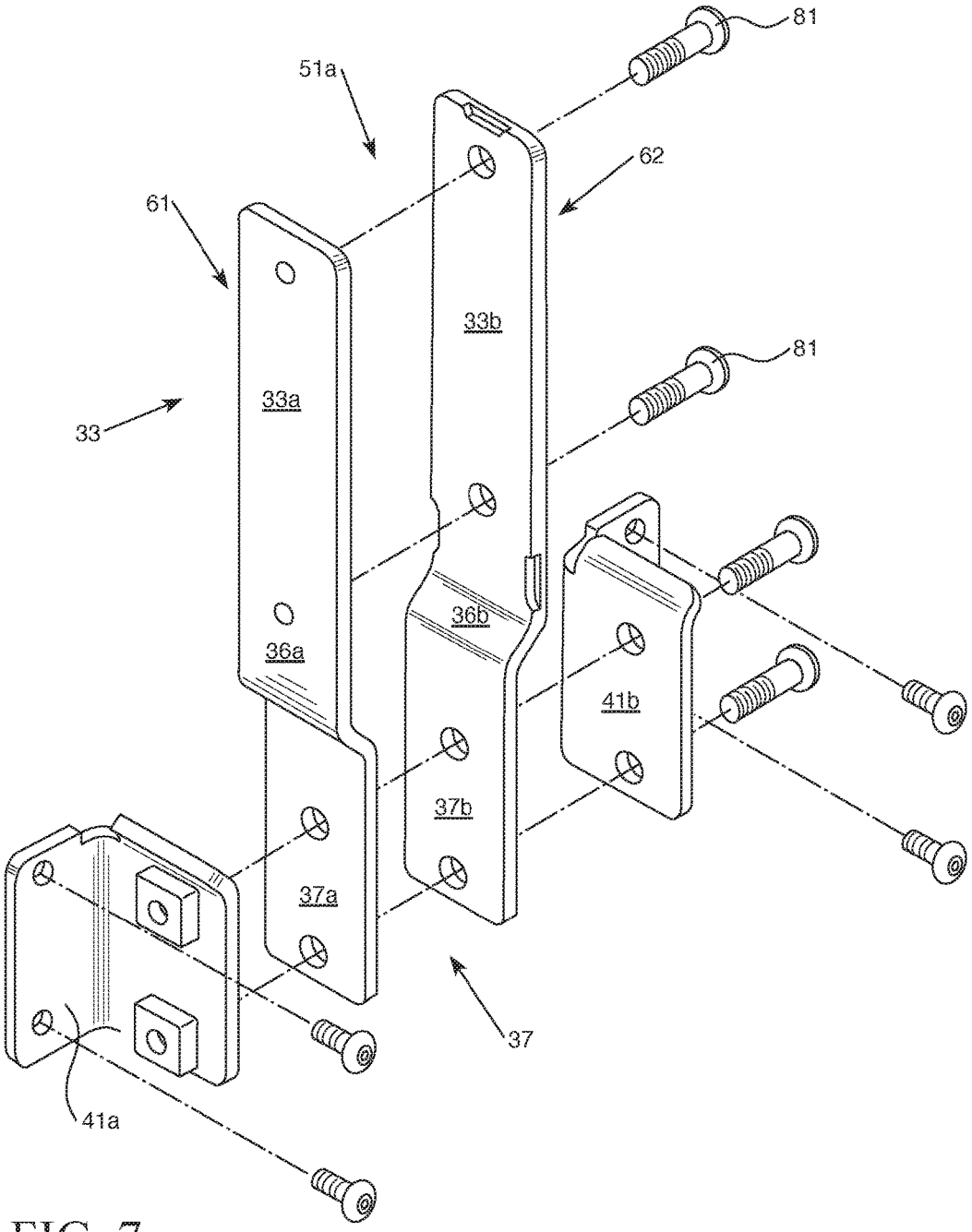
FIG. 7 is a second exploded view of the exemplary embodiment of the privacy screen connector 31 shown in FIG. 5.
Figure 8:
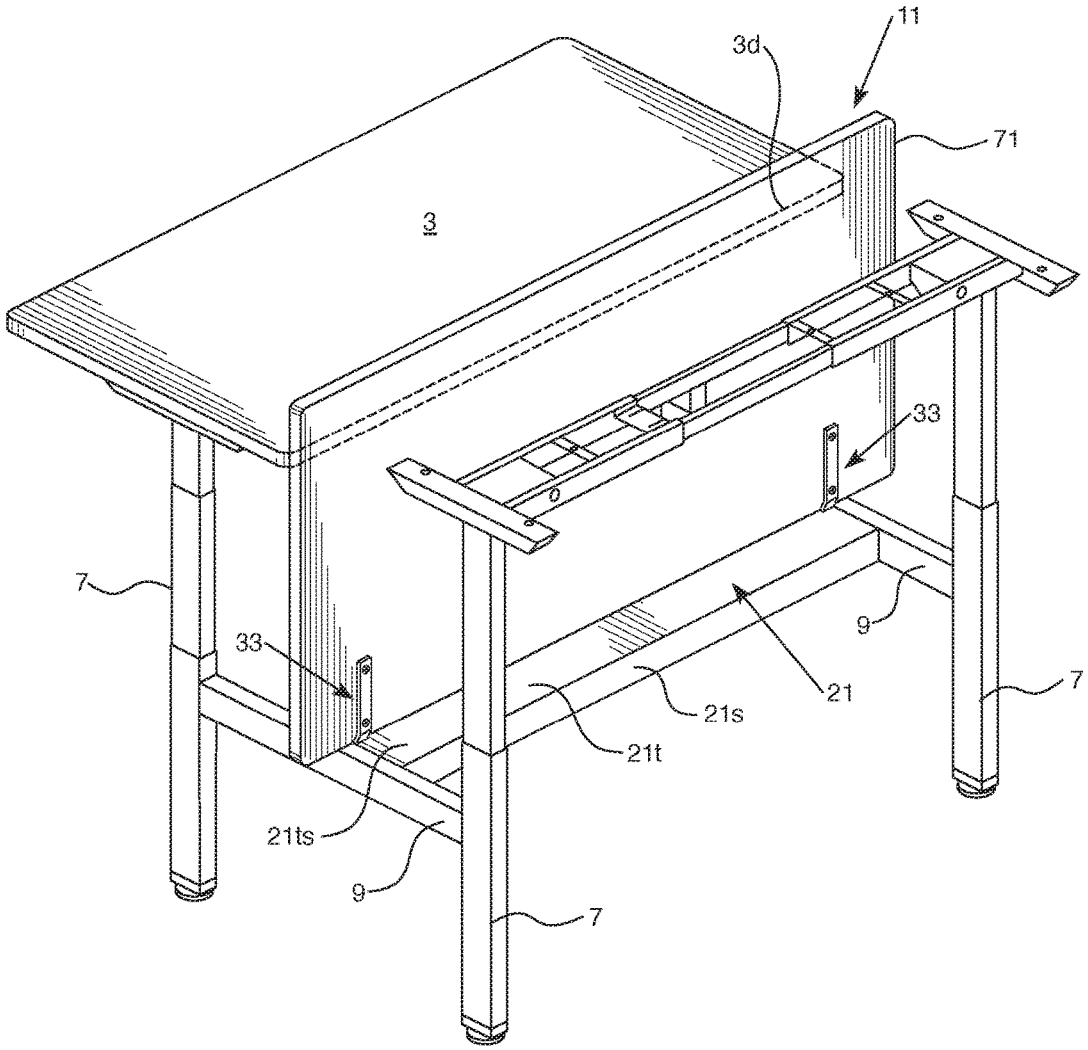
FIG. 8 is a view of the first exemplary embodiment of the table arrangement 1 similar to FIG. 2 with a privacy screen member 71 connected to the base member 21 and one of the tabletops cut away to better illustrate the privacy screen member 71.

The table arrangement can include multiple privacy screen connectors 31 to position a privacy screen member 71 on the base member 21 so that a portion of the privacy screen member 71 can extend through the gap 11 and above the tabletops to provide a visible barrier between the first and second tabletops 3*a* and 3*b*. In some embodiments, there may be a first privacy screen connector 31 positioned in a first slot 22 and in a gap 43 of a first bracket 41 adjacent a first cross-member 9*a* and there may be a second privacy screen connector 31 positioned in a second slot 22 and in a gap 43 of a second bracket 41 adjacent a second cross-member 9*b*. FIGS. 5-7 illustrate an example of an embodiment of the privacy screen connector 31. It should be appreciated that first and second privacy screen connectors 31 can each have the structure of the exemplary embodiment shown in FIGS. 5-7.

A lower end portion of each privacy screen connector 31 can extend downwardly from a slot 22 of the base member 21 to the bracket to which it is attached. An upper portion of each privacy screen connector can extend above the slot 22 and be configured to receive and retain a respective portion of the privacy screen member 71 on the base member 21 and/or adjacent the base member 21. For instance, the first privacy screen connector 31 can have an upper portion 33 that is configured to retain a first portion of a privacy screen member 71 and the second privacy screen connector 31 can have an upper portion 33 that is configured to retain a second portion of a privacy screen member 71. The first and second portions of the privacy screen member 71 can be portions of the same member that are spaced apart from each other along the length of the privacy screen member 71.

For example, each privacy screen connector 31 can include an upper portion 33 and a lower end portion 37 that are integrally attached to each other such that an upper slot with a top mouth 51*a* in communication with a channel 35 is defined between upper spaced apart upper bodies 33*a* and 33*b* of the upper portion 33. The top mouth 51*a* can be defined for receiving a portion of a privacy screen member 71. The channel 35 in communication with the top mouth 51*a* can be configured for retaining a portion of a lower end or lower side of the privacy screen member 71.

The upper portion 33 of the privacy screen connector 31 can be above the slot 22 to which that privacy screen connector is to be positioned. The upper portion 33 can define a top portion of the privacy screen connector 31 that extends above the slot 22 in which that privacy screen connector 31 is positioned. The lower end portion 37 of the privacy screen connector 31 can extend downwardly from the slot 22 (or adjacent the slot 22) to within the gap 43 for being attached to the bracket 41 via fasteners (e.g. bolts, screws, etc.). The lower end portion 37 can define a bottom end portion of the privacy screen connector 31.

Each side of the privacy screen connector 31 can be defined by an integrally molded or cast metal structure or polymeric structure. These structures may be spaced apart from each other to define the upper mouth 51*a* and channel 35 of the upper portion 33 and contact each other at their lower portions to define the lower end portion 37 to be narrower than the channel 35 that receives and holds the privacy screen member 71 for insertion through a slot 22 and a bracket gap 43. Each integral cast or formed member can have an intermediate angled portion to define this widening/narrowing region. For instance, a first member 61 of the privacy screen connector 31 can define a first upper body 33*a*, a first lower body 37*a* and a first widening/narrowing body 36*a* that is a first intermediate body positioned between the first upper body 33*a* and first lower body 37*a*. The second member 62 of the privacy screen connector 31 can define a second upper body 33*b*, a second lower body 37*b* and a second widening/narrowing body 36*b* that is a second intermediate body between the second upper body 33*b* and second lower body 37*b*.

The first member 61 of the privacy screen connector 31 can be a unitary structure in which the first upper body 33*a*, first lower body 37*a* and the first widening/narrowing body 36*a* that is between the first upper body 33*a* and first lower body 37*a* are portions of an integral, unitary structure (e.g. a metal structure formed as a single, unitary piece, a polymeric structure molded or otherwise formed as a single, unitary piece, etc.). The second member 62 of the privacy screen connector 31 can be a unitary structure in which the second upper body 33*b*, second lower body 37*b* and the second widening/narrowing body 36*b* that is between the second upper body 33*b* and second lower body 37*b* are portions of an integral, unitary structure (e.g. a metal structure formed as a single, unitary piece, a polymeric structure molded or otherwise formed as a single, unitary piece, etc.). Fasteners can be utilized to connect the first member 61 of the privacy screen connector to the second member 62 of the privacy screen connector. In other embodiments, the entire body and structure of each privacy screen connector 31 can be formed as a unitary structure (e.g. via casting, molding, and/or welding).

The privacy screen connectors 31 and brackets 41 can be utilized to provide a connection of the privacy screen member 71 at opposite ends of the lower base member 21 via spaced apart slots 22. This connection can permit the privacy screen member 71 to be inserted into the channels 35 of the privacy screen connectors 31 via the top mouths 51*a* of those connectors 31 so that screen rigidity can be provided. After the privacy screen member 71 is positioned in the channels 35, one or more fasteners 81 can be inserted into the privacy screen connectors 31 to pass through the privacy screen member 71 to help retain the privacy screen member 71. Each fastener 81 can extend from a hole defined in the first upper body 33*a* to a hole defined in the second upper body 33*b* so that the fastener 81 is positionable in the channel and is passable through the privacy screen member 71. Each privacy screen connector 31 can be configured to utilize at least one such fastener 81. In yet other embodiments, such fasteners 81 may not be used and the privacy screen member 71 can be retained via an interference fit between the first and second upper bodies 33*a* and 33*b* of each privacy screen connector 31 or otherwise being physically retained between these upper bodies 33*a* and 33*b* (e.g. a looser retention than a tight interference fit, etc.).

The rigid support of the privacy screen member 71 can permit a relatively tall privacy screen member 71 to be mounted to extend through the gap 11 between tabletops 3 and provide a desired height above the tabletops to accommodate height adjustment of the tabletops while still providing a desired level of privacy protection to the workers who may work at their respective tabletops 3. The height to which the privacy screen member 71 can extend above the tabletops 3 can be facilitated via the privacy screen connection mechanism that includes the spaced apart privacy screen connectors 31 and brackets 41 to which they are connected and slots 22 defined in the base member 21 as well as the top surface 21*ts* of the base member 21 on which a lower edge of the privacy screen member may abut or be adjacent.

It should be understood that embodiments of the table arrangement 1 and connection mechanisms used in that embodiment may be configured to meet different design criteria. For instance, the tabletops 3 may not be height adjustable or may be height adjustable and also be pivotable or otherwise moveable. As yet another example, the bottom of each column 7 may be configured to contact a floor, be connected to a foot for stationary positioning on the floor, or be connected to a rollable wheel or castor. As yet another example, there may be more than two columns (e.g. three columns, four columns, etc.) under any particular tabletop 3 to principally support that tabletop in some embodiments of the table arrangement 1.

As yet another example, in some embodiments the base member 21 can include at least one first end wall 21*ew* and at least one second end wall 21*ew* on opposite ends of the base member that extend below the top 21*t* between opposite sidewalls 21*s* that extend below the top 21*t* at opposite front and rear sides of the base member 21. In some embodiments in which end walls and sidewalls are present, the sidewalls 21*s* can extend along a length L of the base member 21 and the end walls 21*ew* can extend along the entire width W of the base member 21. In some embodiments, the end walls 21*ew* may not extend along the entire width W of the base member to define a particular type of shape or define one or more apertures for facilitating a connection of a bracket 41 to a cross-member 9. In yet other embodiments, the end walls 21*ew* may not be present and the first and second bodies 41*a* and 41*b* of the bracket 41 may be attached directly to a cross-member 9 without the end wall 21*ew* being between the cross-member 9 and the bracket 41.

As yet another example, the size, shape, and configuration of each of the privacy screen connectors 31 can be adjusted to meet a particular set of design objectives (e.g. accommodation of a particular sized and shaped privacy screen member 71, particular size and shape of gap 11 or tabletop 3, particular size and shape of bracket 41 and/or cross-member 9, etc.). Therefore, while certain exemplary embodiments of the table arrangement, privacy screen connection mechanisms used in the table arrangement and methods of making and using the same have been discussed and illustrated herein, it is to be distinctly understood that the invention is not limited thereto but may be otherwise variously embodied and practiced within the scope of the following claims.

What is claimed is:

1. A table arrangement comprising:

a first tabletop;

a second tabletop;

a base that supports the first tabletop and the second tabletop, the base comprising:

a first column positioned below the first tabletop;

a second column positioned below the second tabletop;

a base member positioned between the first column and the second column, the base member also positioned below a gap defined between the first tabletop and the second tabletop, the base member having a first slot; and a first privacy screen connector positioned so that a lower end portion of the first privacy screen connector extends downwardly from the first slot, an upper portion of the first privacy screen connector configured to receive and retain a first portion of a privacy screen member.

2. The table arrangement of claim 1, wherein the privacy screen member is a partition panel, a partition wall, or a privacy screen.

3. The table arrangement of claim 1, comprising:

a first bracket positioned within a bottom opening of the base member to receive the lower end portion of the first privacy screen connector.

4. The table arrangement of claim 3, wherein the base member has a second slot and the table arrangement comprises:

a second privacy screen connector positioned so that a lower end portion of the second privacy screen connector extends downwardly from the second slot, an upper portion of the second privacy screen connector configured to receive and retain a second portion of the privacy screen member.

5. The table arrangement of claim 4, comprising:

a second bracket positioned within the bottom opening of the base member to receive the lower end portion of the second privacy screen connector.

6. The table arrangement of claim 4, wherein the first privacy screen connector is configured as a unitary structure and the second privacy screen connector is configured as a unitary structure.

7. The table arrangement of claim 1, wherein the lower end portion of the first privacy screen connector comprises: a first lower body abutting a second lower body.

8. The table arrangement of claim 7, wherein the upper portion of the first privacy screen connector comprises a first upper body that is spaced apart from a second upper body to define a top mouth and a channel in communication with the top mouth for receipt and retention of the first portion of the privacy screen member.

9. The table arrangement of claim 8, wherein there is a first intermediate body that extends between the first upper body and the first lower body, the first intermediate body narrowing the channel at a bottom end of the channel.

10. The table arrangement of claim 1, wherein the base member has a second slot, the table arrangement also comprising:

a second privacy screen connector positioned so that a lower end portion of the second privacy screen connector extends downwardly from the second slot, an upper portion of the second privacy screen connector configured to receive and retain a second portion of the privacy screen member;

a first bracket positioned within a bottom opening of the base member adjacent the first slot to receive the lower end portion of the first privacy screen connector, the first bracket comprising a first bracket body that is spaced apart from a second bracket body to define a gap of the first bracket for receiving the lower end portion of the first privacy screen connector; and a second bracket positioned within the bottom opening of the base member adjacent the second slot to receive the lower end portion of the second privacy screen connector, the second bracket comprising a first bracket body that is spaced apart from a second bracket body to define a gap of the second bracket for receiving the lower end portion of the second privacy screen connector.

11. The table arrangement of claim 10, wherein the first slot is positioned adjacent a first end of the base member and the second slot is positioned adjacent a second end of the base member that is opposite the first end of the base member.

12. The table arrangement of claim 11, comprising:

a first cross-member extending between the first column and the second column;

the first bracket body of the first bracket attached to the first cross-member and the second bracket body of the first bracket attached to the first cross-member.

13. The table arrangement of claim 12, wherein the base that supports the first and second tabletops also comprises a third column positioned below the first tabletop and a fourth column positioned below the second tabletop; and the table arrangement also comprises:

a second cross-member extending between the third column and the fourth column;

the first bracket body of the second bracket attached to the second cross-member and the second bracket body of the second bracket attached to the second cross-member.

14. The table arrangement of claim 13, wherein the first slot is aligned with the gap of the first bracket and the second slot is aligned with the gap of the second bracket.

15. The table arrangement of claim 14, wherein:

the upper portion of the first privacy screen connector comprises a first upper body that is spaced apart from a second upper body to define a top mouth and a channel in communication with the top mouth for receipt and retention of the first portion of the privacy screen member; and the upper portion of the second privacy screen connector comprises a first upper body that is spaced apart from a second upper body to define a top mouth and a channel in communication with the top mouth for receipt and retention of the second portion of the privacy screen member.

16. The table arrangement of claim 15, wherein:

the lower end portion of the first privacy screen connector comprises: a first lower body abutting a second lower body; and the lower end portion of the second privacy screen connector comprises: a first lower body abutting a second lower body.

17. The table arrangement of claim 16, wherein:

the first privacy screen connector comprises:

a first intermediate body that extends between the first upper body and the first lower body of the first privacy screen connector, a second intermediate body that extends between the second upper body and the second lower body of the first privacy screen connector, the first intermediate body and the second intermediate body of the first privacy screen connector positioned and configured so that the channel of the first privacy screen connector is narrower at a bottom end of the channel as compared to a portion of the channel adjacent the top mouth of the first privacy screen connector; and the second privacy screen connector comprises:

a first intermediate body that extends between the first upper body and the first lower body of the second privacy screen connector, a second intermediate body that extends between the second upper body and the second lower body of the second privacy screen connector, the first intermediate body and the second intermediate body of the second privacy screen connector positioned and configured so that the channel of the second privacy screen connector is narrower at a bottom end of the channel as compared to a portion of the channel adjacent the top mouth of the second privacy screen connector.

18. The table arrangement of claim 17, comprising:

the privacy screen member, the first portion of the privacy screen member received in the channel of the first privacy screen connector and the second portion of the privacy screen member received in the channel of the second privacy screen connector.

19. The table arrangement of claim 18, wherein:

the first column has a height adjustment mechanism at least partially positioned therein;

the second column has a height adjustment mechanism at least partially positioned therein;

the third column has a height adjustment mechanism at least partially positioned therein;

and the fourth column has a height adjustment mechanism at least partially positioned therein.

20. A method of positioning a privacy screen between tabletops of a table arrangement, the method comprising:

providing a table arrangement, the table arrangement comprising:

a first tabletop;

a second tabletop;

a base that supports the first tabletop and the second tabletop, the base comprising:

a first column positioned below the first tabletop, a second column positioned below the second tabletop, a base member positioned between the first column and the second column, the base member also positioned below a gap defined between the first tabletop and the second tabletop, the base member having a first slot and a second slot spaced apart from the first slot;

positioning a first privacy screen connector so that a lower end portion of the first privacy screen connector extends downwardly from the first slot and an upper portion of the first privacy screen connector extends upwardly from the first slot and is configured to receive and retain a first portion of a privacy screen member;

positioning a second privacy screen connector so that a lower end portion of the second privacy screen connector extends downwardly from the second slot and an upper portion of the second privacy screen connector extends upwardly from the second slot and is configured to receive and retain a second portion of the privacy screen member; and positioning the first portion of the privacy screen member in a channel of the first privacy screen connector and positioning the second portion of the privacy screen member in a channel of the second privacy screen connector such that the privacy screen member extends through the gap and extends above the first tabletop and the second tabletop.

* * * * *